US008290417B2

(12) United States Patent
Sakai

(10) Patent No.: US 8,290,417 B2
(45) Date of Patent: Oct. 16, 2012

(54) BELT DEVICE AND IMAGE FORMING APPARATUS

(75) Inventor: Masato Sakai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 243 days.

(21) Appl. No.: 12/752,243

(22) Filed: Apr. 1, 2010

(65) Prior Publication Data

US 2010/0254737 A1 Oct. 7, 2010

(30) Foreign Application Priority Data

Apr. 2, 2009 (JP) ..... 2009-089766

(51) Int. Cl.
*G03G 15/20* (2006.01)

(52) U.S. Cl. ..... 399/329; 399/331

(58) Field of Classification Search ..... 399/328, 399/329, 333, 330, 331
See application file for complete search history.

(56) References Cited

U.S. PATENT DOCUMENTS

2009/0010686 A1* 1/2009 Matsumoto ..... 399/324

FOREIGN PATENT DOCUMENTS

| | | | |
|---|---|---|---|
| JP | 2003-091188 | A | 3/2003 |
| JP | 2004-037764 | A | 2/2004 |
| JP | 2005-189746 | A | 7/2005 |
| JP | 2005-275371 | A | 10/2005 |
| JP | 2007-057784 | A | 3/2007 |

* cited by examiner

*Primary Examiner* — Hoang Ngo
(74) *Attorney, Agent, or Firm* — Panitch Schwarze Belisario & Nadel LLP

(57) ABSTRACT

A belt device includes a belt member and a pressurizing member. The belt member is rotated with rotation of a rotation member, and the pressurizing member includes a pressing portion pressing an inner circumferential surface of the belt member. The pressing portion includes a surface layer having a solid lubricating agent and a fine particle.

15 Claims, 5 Drawing Sheets

BELT DEVICE AND IMAGE FORMING APPARATUS

BACKGROUND OF THE INVENTION

1. Field of the Invention

The present invention relates to a belt device and to an image forming apparatus such as a facsimile machine and a printer employing an electrophotographic recording method.

2. Description of Related Art

In a related-art image forming apparatus employing an electrophotographic recording method, a recording medium including a not yet fixed toner image formed thereon is inserted in a fixing device, so that the toner image is fixed on the recording medium with application of the heat and pressure. Such a related-art fixing device includes a pressurizing member and a fixing member including a cylindrical metallic core having a heat source disposed thereinside. The pressurizing member applies the pressure with respect to the fixing member through a belt member to form a nip portion through which the recording medium with the not yet fixed toner image is inserted.

Patent Document 1, for example, discloses a related-art fixing device including: a heating member, serving as a fixing member, rotatably driven; a belt member, disposed in contact with the heating member, forming a fixing region between the heating member and thereof; a pressurizing member, disposed opposite to the heating member, pressing the heating member with a prescribed pressure by way of the belt member; and a pressing member pushing the pressurizing member. The pressing member can evenly adjust a pressure distribution in the nip portion, thereby enhancing the quality of the image on the recording medium.

Patent Document 1: Japanese Unexamined Patent Application Publication No. 2005-189746

The related-art fixing device disclosed in Patent Document 1, however, can cause the belt member to be not stably driven. For example, since the pressurizing member pressing the fixing member with the prescribed pressure slides in contact with an inner circumferential surface of the belt member and presses the fixing member through the belt member, frictional resistance between the inner circumferential surface of the belt member and the pressurizing member is increased, causing an increase in a driving torque of the fixing member. Consequently, an abnormal noise can be generated from a drive motor of the fixing member, or the related-art fixing device can be poorly driven caused by synchronization loss of the drive motor. In addition to such drawbacks, the pressurizing member can easily deform in an arch shape with an increase in a frictional force between the pressurizing member and the belt member in the related-art fixing device. In a case where the pressurizing member is returned to an original state from the arch shape in excess of deforming limitation, a friction noise can be generated.

The present invention is proposed in consideration of the aforementioned situations, and provides a belt device capable of allowing a belt to be stably driven and an image forming apparatus including the belt device.

BRIEF SUMMARY OF THE INVENTION

According to an aspect of the present invention, a belt device includes: a belt member being rotated with rotation of a rotation member; and a pressurizing member including a pressing portion pressing an inner circumferential surface of the belt member. The pressing portion includes a surface layer having a solid lubricating agent and a fine particle.

According to another aspect of the present invention, an image forming apparatus includes: a medium tray; a medium conveyance mechanism; an image forming unit; and a belt device. The belt device includes: a belt member being rotated with rotation of a rotation member; and a pressurizing member including a pressing portion pressing an inner circumferential surface of the belt member. The pressing portion includes a surface layer having a solid lubricating agent and a fine particle.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the present invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
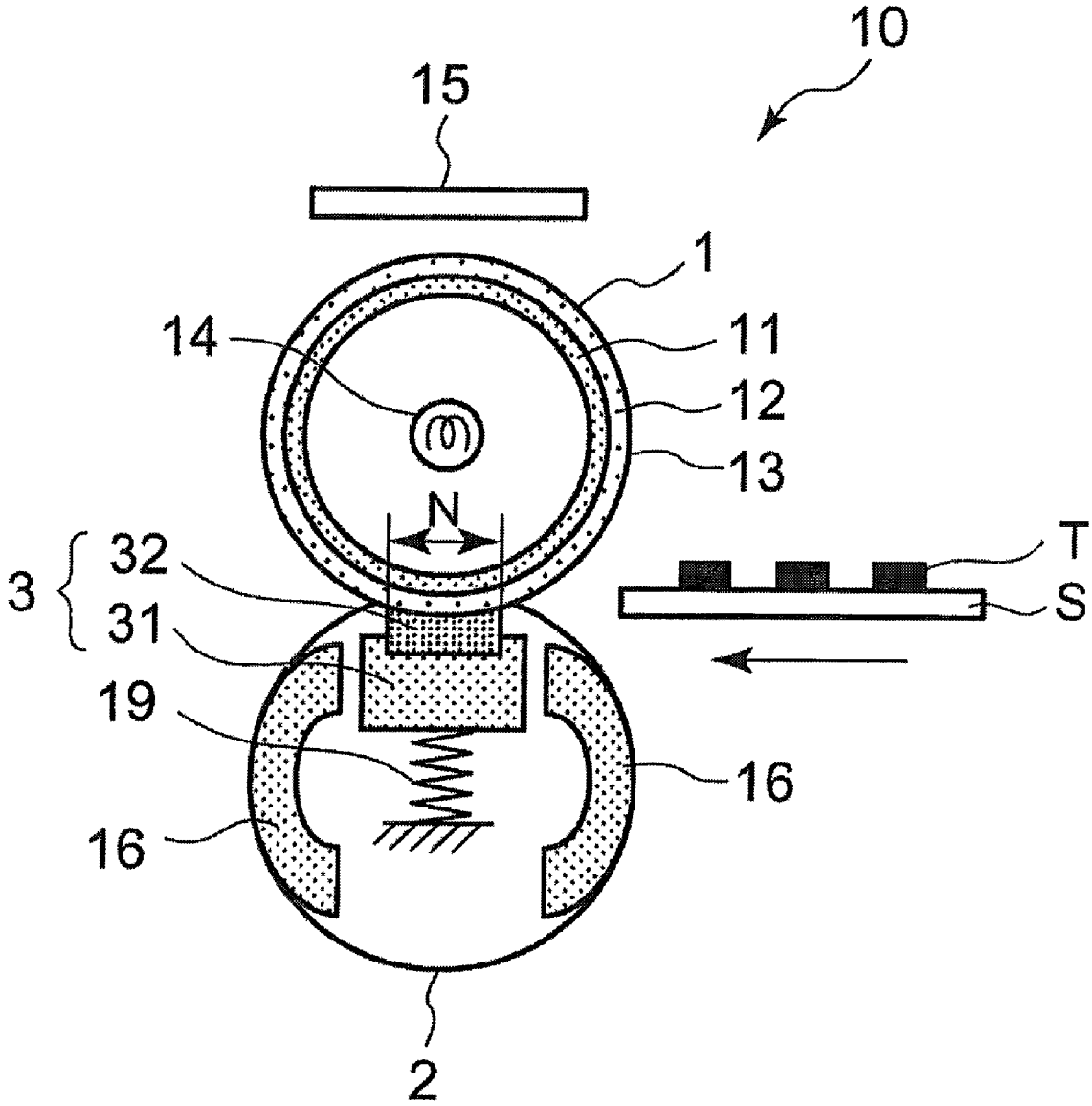
FIG. 1 is a schematic diagram illustrating a fixing device according to a first embodiment of the present invention.

A belt device and an image forming apparatus according to preferred embodiments of the present invention are now described more fully hereinafter with reference to the accompanying drawings. The present invention may, however, be embodied in many different forms and should not be construed as limited to the embodiments set forth herein. The embodiments, therefore, may be modified or varied without departing from the scope of the present invention.

In describing embodiments illustrated in the drawings, specific terminology is employed for the sake of clarity. However, the disclosure of the patent specification is not intended to be limited to the specific terminology so selected, and it is to be understood that each specific element includes all technical equivalents that operate in a similar manner. Preferred embodiments of the present invention are described in detail referring to the drawings, wherein like reference numerals designate identical or corresponding parts throughout the several views.

First Embodiment

Figure 2:
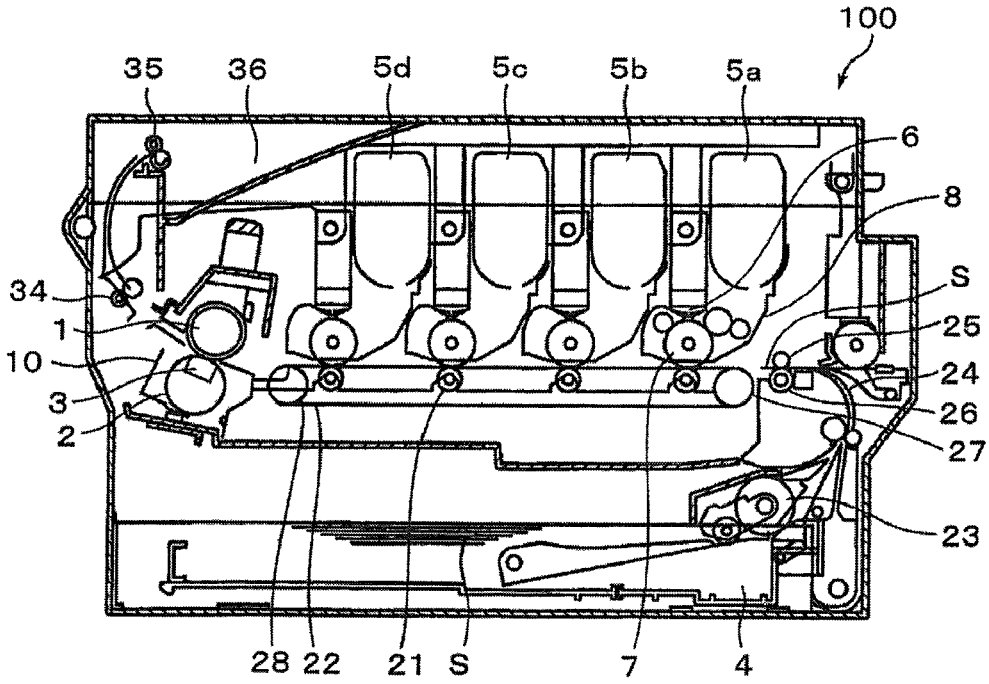
FIG. 2 is a schematic diagram illustrating a printer according to the first embodiment of the present invention.

Referring to FIG. 2, a printer 100 serving as an image forming apparatus according to a first embodiment of the present invention is illustrated. The printer 100 includes a medium tray 4 disposed in a lower portion thereof. The medium tray 4 stores a recording sheet S serving as a recording medium therein, and the recording sheet S is fed to a conveyance path 24 sheet by sheet by a hopping roller 23. The conveyance path 24 is formed with: a registration roller (also referred to as a pressure roller) 25 conveying the recording sheet S to a transfer belt 22 without skewing the recording sheet S; and a registration roller (also referred to as a feed roller) 26 conveying the recording sheet S to the transfer belt 22.

The printer 100 includes four image forming units 5*a*, 5*b*, 5*c*, and 5*d* disposed in a sheet conveyance direction of the recording sheet S. Each of the image forming units 5*a*, 5*b*, 5*c*, and 5*d* includes a development device 8 and a toner of a different color stored therein, so that the printer 100 is capable of performing a multi-color printing. Each of the image forming units 5*a*, 5*b*, 5*c*, and 5*d* includes a photosensitive drum 7 disposed in such a manner as to be rotatable with a prescribed rotation speed. The photosensitive drum 7 has a surface on which an electrostatic latent image is formed by a light emitting diode (LED) head 6. The development device 8 supplies the toner on the electrostatic latent image on the surface of the photosensitive drum 7 to develop the electrostatic latent image.

The transfer belt 22 and transfer rollers 21, serving as transfer members, are disposed below the photosensitive drums 7. The transfer rollers 21 allow the toner images on the surfaces of the respective photosensitive drums 7 to be transferred from the photosensitive drums 7 to the recording sheet S. The transfer belt 22 rotatably extends between an idle roller 27 and a drive roller 28, and is rotated by driving force of the drive roller 28. The transfer rollers 21, allowing the toner images on the respective photosensitive drums 7 to be transferred to the recording sheet S, are disposed directly below the respective photosensitive drums 7.

A fixing device 10 (described in detail later) is disposed on a downstream side of the drive roller 28 in the sheet conveyance direction. The fixing device 10 as described in detail below includes: a fixing roller 1, serving as a fixing member, having a heating mechanism; and a fixing belt 2 serving as a belt member. The fixing device 10 allows a not yet fixed toner image T transferred to the recording sheet S to be fixed on the recording sheet S using the heat. Ejection rollers 34 and 35 are disposed on a downstream side of the fixing device 10 in the sheet conveyance direction such that the recording sheet S including the image fixed thereon is ejected to an ejection portion 36.

Referring to FIG. 1, the printer 10 according to the first embodiment is illustrated in a schematic diagram. The fixing device 10 includes: the fixing roller 1, in a cylindrical shape, including the heating mechanism thereinside; the fixing belt 2 having a shape of a thin film; and a pressurizing pad 3, serving as a pressurizing member in an elongated shape, disposed perpendicular to the sheet conveyance direction of the recording sheet S. The fixing belt 2 is pressed on the side of the fixing roller 1 by the pressurizing pad 3 disposed inside the fixing belt 2, so that a nip portion N is formed between the fixing roller 1 and the fixing belt 2. The recording sheet S, serving as the recording medium, including the not yet fixed toner image T carried thereon passes the nip portion N. Accordingly, the recording sheet S is applied with the heat and pressure, so that the not yet fixed toner image T is fixed on the recording sheet S.

The fixing roller 1 is rotated by a fixing roller drive motor serving as a drive mechanism (not shown), and the rotation of the fixing roller 1 allows the fixing belt 2 to be rotated, thereby conveying the recording sheet S being inserted to the nip portion N. The fixing roller 1 includes: a metallic core 11 having a cylindrical shape; an elastic layer 12 formed on a surface of the metallic core 11; and a releasing layer 13. The metallic core 11 includes a halogen lamp 14, serving as the heating mechanism, disposed thereinside.

The metallic core 11 can be made of a material having a good mechanical strength and a high thermal conductivity, for example, a metal or alloy such as aluminium, SUS (i.e., stainless used steel standardized by Japanese Industrial Standards), iron, copper, and brass. The elastic layer 12 can be made of a generally-known-material having elasticity, for example, silicone rubber, and fluorine rubber. Although there is not a particular restriction on a method for forming the elastic layer 12, a coating method or an injection molding method is generally employed. The releasing layer 13 is provided to reduce or prevent the offset in a case where the not yet fixed image T is fixed on the recording sheet S. The releasing layer 13 is provided by coating a fluorine resin and the like having a heat resistance property or releasability on the elastic layer 12, or provided by attaching a fluorine resin having a tube shape to the elastic layer 12 with a primer agent.

The heating mechanism heating the fixing roller 1 can be in any shape and have any structure as long as the heating mechanism is stored inside the fixing roller 1. For example, the halogen lamp 14 can be employed as the heating mechanism to heat a surface of the fixing roller 1. A non-contact thermistor 15, for example, can measure a surface temperature of the fixing roller 1 heated by the halogen lamp 14. The non-contact thermistor 15 can measure the surface temperature of the fixing roller 1 in a non-contact manner, and a temperature control mechanism (not shown) can control the surface temperature of the fixing roller 1 to be a certain level. The measurement mechanism measuring the surface temperature of the fixing roller 1 is not limited to the non-contact thermistor 15. A contact thermistor, a temperature sensor, or the like can be employed as the measurement mechanism. Moreover, the temperature control mechanism can be, for example, a temperature controller, and a computer.

The fixing belt 2 is formed in an endless shape having a width substantially the same as a width of the fixing roller 1. As described above, the fixing belt 2 is rotated between the pressurizing pad 3 and the fixing roller 1 in a rotation direction with the rotation of the fixing roller 1, thereby conveying the recording sheet S. The fixing belt 2 can include a base member having a single layer structure. Alternatively, the fixing belt 2 can include a base member having a multi-layer structure in which a releasing layer is provided on a surface of the base member.

The fixing belt 2 includes the base member, for example, made of polymer such as thermosetting polyimide, thermoplastic polymide, polyamide, and polyamide-imide, or made of a metal such as stainless, nickel, and copper. The fixing belt 2 includes the releasing layer preferably made of a material having good releasability with respect to the toner, for example, fluorine resin such as polytetrafluoroethylene (PTFE), tetrafluoroethylene-perfluoroalkyl vinyl ether copolymer (PFA), and tetrafluoroethylene-hexafluoropropylene copolymer (FEP).

The pressurizing pad 3 is disposed on the inner side of the fixing belt 2, and slides in contact with the inner circumferential surface of the fixing belt 2. The pressurizing pad 3 has a function of pressing the side of the fixing roller 1 through the fixing belt 2. The pressurizing pad 3 includes: a pressurizing pad support member 31, serving as a pressing portion support member, being in a recessed cross-sectional shape; and an elastic member 32, serving as a pressing portion, disposed in a recessed portion of the pressurizing pad support member 31. A belt travel guide 16 is disposed to an inner circumference of the fixing belt 2 to guide the rotation of the fixing belt 2. The belt travel guide 16 includes flanges on both sides thereof in a longitudinal direction, that is, right and left sides of the fixing belt 2 in the conveyance direction. Each of the flanges is formed in a protruding rim shape in such a manner as to regulate the fixing belt 2 skewed towards a right and left direction. A compression coil spring 19 is disposed to the pressurizing pad 3 to press the pressurizing pad 3 towards the side of the fixing roller 1 with a prescribed pressure. Therefore, one end of the compression coil spring 19 urges the pressurizing pad 3, and another end thereof is secured to the belt travel guide 16.

Figure 3:
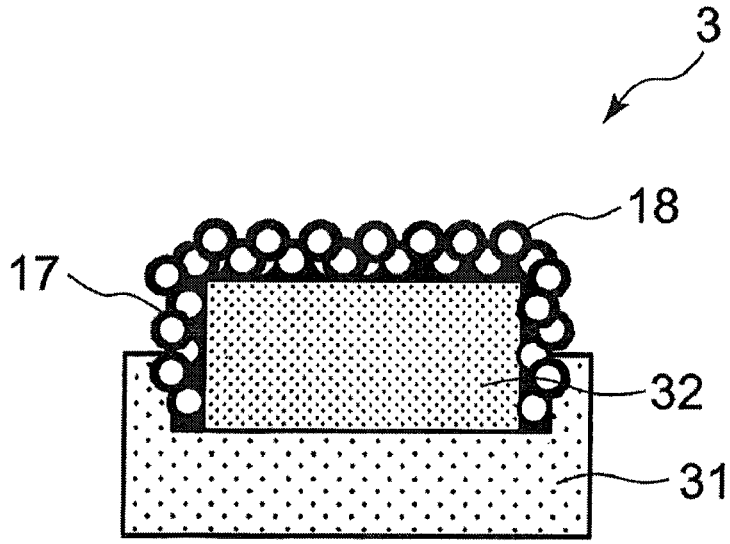
FIG. 3 is a schematic diagram illustrating a pressurizing pad according to the first embodiment of the present invention.

Referring to FIG. 3, the pressurizing pad 3 according to the first embodiment is illustrated. The pressurizing pad 3 includes the pressurizing pad support member 31 supporting the elastic member 32. The pressurizing pad support member 31 can be made of a material such as a metal or alloy such as aluminium, iron, SUS, copper, and brass. Alternatively, the pressurizing pad support member 31 can be a molded product, for example, using a PPS material having a good heat resistance property. The elastic member 32, for example, can be made of silicone rubber and fluorine rubber. According to the first embodiment, for example, in a case where the silicone rubber is used for the elastic member 32, a coating layer 17, serving as a surface layer, is provided on the surface of the elastic member 32 to obtain slidability with the inner circumferential surface of the fixing belt 2. The coating layer 17 is formed by adding graphite serving as a solid lubricating agent on the surface of the elastic member 32.

Herein, the solid lubricating agent generally represents a solid having a lubrication property in contrast to a liquid lubricating oil such as lubricant. The solid lubricating agent hardly causes a real contact between friction surface materials. The lubricant tends to cause a plastic deformation by a shortage of the oil in a high load region or a low speed region. The solid lubricating agent, on the other hand, can allow a solid lubricating membrane to be formed on the friction surface, thereby reducing an occurrence of the plastic deformation. The graphite is a layered crystal mineral and, for example, has a low friction property by shear due to weak bonding strength between layers or by slippage among particles. According to the first embodiment, the solid lubricating agent is described using the graphite as an example. However, the solid lubricating agent is not limited thereto. For example, molybdenum disulfide, fluorine resin (e.g, PTFE), and boron nitride (BN) can be used for the solid lubricating agent.

The coating layer 17 is provided on the surface of the elastic member 32 of the pressurizing pad 3, and the pressurizing pad 3 is pressed by the compression coil spring 19, so that the coating layer 17 directly slides in contact with the fixing belt 2. According to the first embodiment, the solid lubricating agent forming the coating layer 17 includes silicone beads 18 provided thereinside beforehand to set a surface roughness of the pressurizing pad 3. The mixture of the silicone beads 18 and the solid lubricating agent allows the surface roughness Rz of the coating layer 17 to be set between 5 μm and 40 μm. That is, an outside diameter of each of the silicone beads 18 can be selected, so that the surface roughness can be optionally set.

Figure 4:
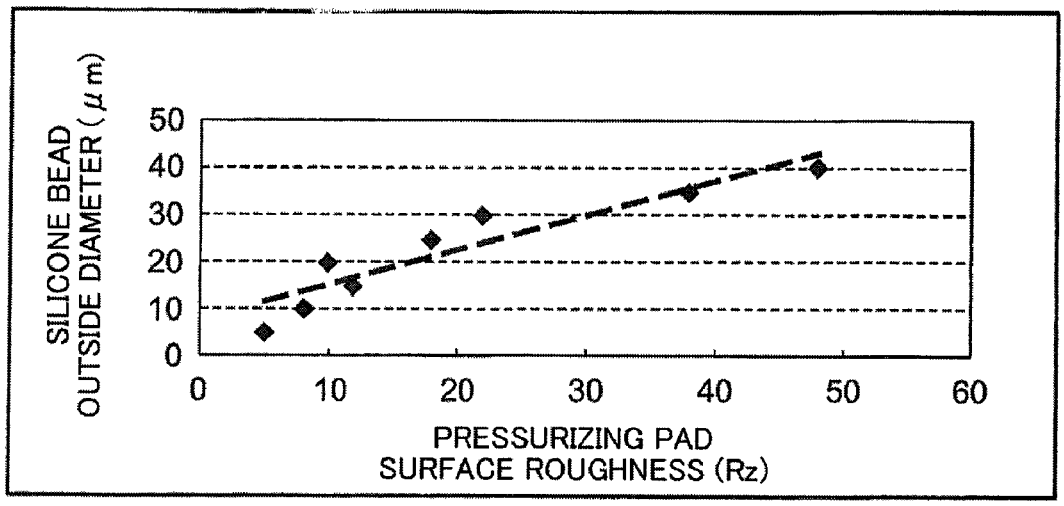
FIG. 4 is a graph illustrating a relationship between outside diameter of a silicone bead and surface roughness of the pressurizing pad.

Referring to a graph of FIG. 4, a description is given of a relationship between the outside diameter of each of the silicone beads 18 and the surface roughness of the pressurizing pad 3. The graph illustrates a measurement result of the surface roughness of the coating layer 17 on the pressurizing pad 3 in a case where each of the silicone beads 18 having the outside diameter shown in a vertical axis of the graph was mixed with the solid lubricating agent. The greater the outside diameter of the silicone bead 18, the greater the tendency to increase the surface roughness of the coating layer 17.

Figure 5:
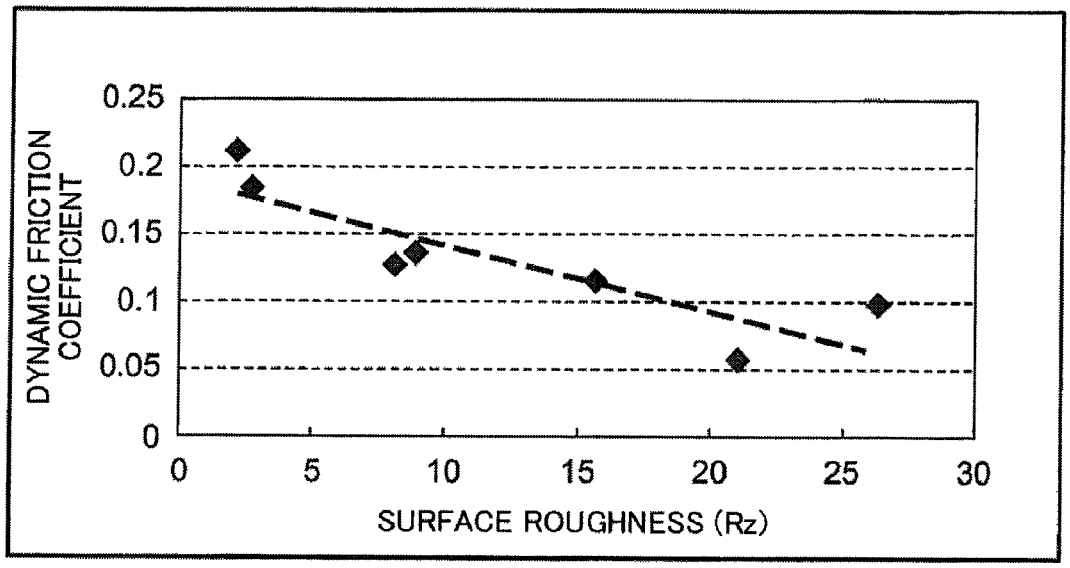
FIG. 5 is a graph illustrating a relationship between the surface roughness of the pressurizing pad and dynamic friction coefficient.

Referring to a graph of FIG. 5, a description is given of a relationship between the surface roughness of the pressurizing pad 3 and a dynamic friction coefficient. The graph illustrates a measurement value that was obtained by measuring the dynamic friction coefficient with respect to the pressurizing pad 3 including the coating layer 17 having the surface roughness shown in a horizontal axis of the graph. The greater the surface roughness of the coating layer 17, the greater the tendency to reduce the dynamic friction coefficient. An appropriate value for the surface roughness of the coating layer 17 may vary depending on the material of the fixing belt 2. However, the surface roughness of the coating layer 17 may be preferably in a range between approximately 5 μm and 40 μm in Rz. Where the coating layer 17 has the surface roughness Rz of the approximately 5 μm and 40 μm range, the silicone bean 18 has the outside diameter of a range between approximately 5 μm and 40 μm according to the graph of FIG. 4.

Accordingly, the selection of the outside diameter of the silicone bead 18 can allow the surface roughness of the coating layer 17 on the surface of the pressurizing pad 3 to be optionally set, so that the friction coefficient can be reduced by reducing a contact area with the inner circumferential surface of the fixing belt 2, thereby reducing the driving torque of the fixing device 10.

Figure 6:
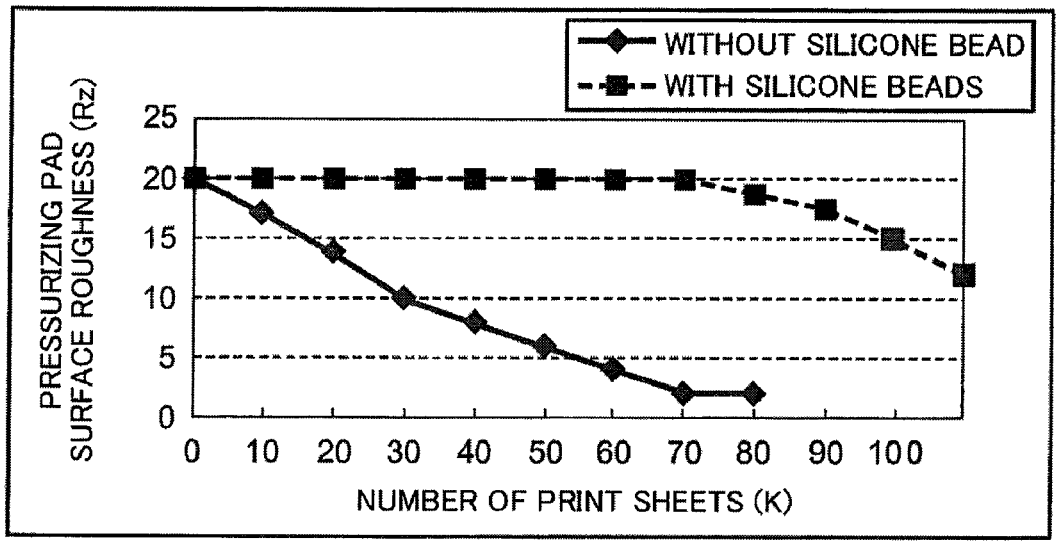
FIG. 6 is a graph illustrating a relationship between the number of print sheets and the surface roughness of the pressurizing pad.

Referring to a graph of FIG. 6, a description is given of a relationship between the number of print sheets and the surface roughness of the pressurizing pad 3. The graph illustrates: an experimental result of a surface roughness of a normal coating layer on the pressurizing pad 3 at a time of printing a prescribed number of sheets by the printer in a case where the normal coating layer was formed by a solid lubricating agent without a silicone bead; and an experimental result of the surface roughness of the coating layer 17 on the pressurizing pad 3 at a time of printing a prescribed number of sheets by the printer in a case where the coating layer 17 was formed by the solid lubricating agent having the silicone beads 18 thereinside according to the first embodiment of the present invention.

As illustrated in the graph of FIG. 6, in a case where the normal coating layer having no silicone bead was repeatedly pressed against the fixing belt 2 with the friction, the surface roughness thereof was gradually reduced due to the friction with the fixing belt 2. The coating layer 17 having the silicone beads 18 thereinside, on the other hand, maintained the surface roughness thereof at a certain level although the number of the print sheets increased. Among the silicone beads 18 included inside the coating layer 17, silicone beads 18 provided on a surface of the coating layer 17 are separated from the coating layer 17 by the repeated friction with the fixing belt 2. However, since the coating layer 17 includes other silicone beads 18 thereinside, the other silicone beads 18 inside the coating layer 17 appear on the surface of the coating layer 17 in a case where the silicone beads 18 on the surface of the coating layer 17 are reduced due to the friction. Such a process continues, so that the coating layer 17 can maintain the roughness on the surface thereof at the certain level while reducing the likelihood of lowering the surface roughness thereof.

Now, a description is given of operation of the fixing device 10 according to the first embodiment of the present invention. When a print instruction is provided to the printer 100, the temperature control mechanism (not shown) allows the halogen lamp 14 to light up to begin heating the fixing roller 1. The non-contact thermistor 15 measures the surface temperature of the fixing roller 1 and outputs to the temperature control mechanism. Upon receiving the surface temperature of the fixing roller 1 from the non-contact thermistor 15, the temperature control mechanism continues to allow the halogen lamp 14 to light up until the surface temperature of the fixing roller 1 reaches a prescribed temperature.

When the surface temperature of the fixing roller 1 reaches a rotation start temperature programmed beforehand, the fixing roller drive motor (not shown) begins to rotate, thereby rotating the fixing roller 1. The fixing belt 2 is rotated between the pressurizing pad 3 and the fixing roller 1 in the rotation direction with the rotation of the fixing roller 1. When the surface temperature of the fixing roller 1 further increases and reaches an appropriate fixing temperature programmed, the hopping roller 23 feeds the recording sheet S to the conveyance path 24. Each of the image forming units 5*a*, 5*b*, 5*c*, and 5*d* performs the image forming process, and the not yet fixed image T is transferred to the recording sheet S by the transfer roller 21 and the transfer belt 22 serving as the transfer members. Subsequently, the recording sheet S including the not yet fixed image T transferred thereon is inserted in the nip portion N formed between the fixing roller 1 and the fixing belt 2.

In the nip portion N, the pressurizing pad 3 applies the pressure on the recording sheet S pressed towards the side of the fixing roller 1, and the recording sheet is applied with the heat by the fixing roller 1 having the prescribed temperature. Therefore, the not yet fixed toner image T is fixed on the recording sheet S with application of the heat and pressure. The pressurizing pad 3 includes the coating layer 17 on the surface thereof. The coating layer 17 has the surface roughness which is set by selecting the outside diameter of the silicone beads 18 as described above. Accordingly, the contact area between the pressurizing pad 3 and the inner circumferential surface of the fixing belt 2 is reduced, thereby reducing the drive torque of the fixing roller drive motor. Moreover, the silicone beads 18 allows the surface roughness of the coating layer 17 on the pressurizing pad 3 to tend not to be lowered, so that the drive torque can be reduced over time.

The silicone beads 18 are included in the solid lubricating agent to set the surface roughness of the coating layer 17 on the surface of the pressurizing pad 3 as described above. According to the first embodiment, each of the silicone beads 18 made of silicone is used as a fine particle. However, the first embodiment of the present invention is not limited thereto. For example, a fine particle made of polymer, a fine particle made of resin having the heat resistance property, and a fine particle made of metal may be used.

Therefore, the first embodiment can reduce (if not prevent) the likelihood of lowering the surface roughness Rz of the pressurizing pad 3 sliding in contact with the inner circumferential surface of the fixing belt 2, thereby reducing an increase of the frictional resistance between the inner circumferential surface of the fixing belt 2 and the pressurizing pad 3. Accordingly, the first embodiment of the present invention can provide the belt device capable of not only reducing the drive torque of the fixing device 10 over time, but also reducing (if not preventing) an abnormal noise generated from the fixing roller, a synchronization loss of the fixing roller drive motor, and a friction noise generated from a deformation of the pressurizing member.

According to the first embodiment, moreover, the fixing belt 2 can be provided without using silicone oil thereinside (i.e., oil-less inside the fixing belt 2), so that permeation of an oil component through the elastic member 32 caused by application of the oil inside the fixing belt 2 can be reduced. Therefore, the deformation of the elastic member 32 or a change in an elastic hardness of the elastic member 32 caused by the permeation of the oil component through the elastic member 32 can be reduced, thereby reducing occurrences of generating wrinkles in a case where the not yet fixed toner image T is fixed on the recording sheet S.

According to the first embodiment, moreover, the fixing belt 2 can be provided without using the silicone oil thereinside (i.e., oil-less inside the fixing belt 2), so that a structure of disposing a sheet for a slidability enhancement between the fixing belt 2 and the elastic member 32 cannot necessarily be employed. Therefore, the first embodiment of the present invention can provide the belt device having a simple structure and reduce the cost thereof.

Second Embodiment

A printer 100 and a fixing device 10 according to a second embodiment are substantially similar to those of the first embodiment described above except for a pressurizing pad 71. Components and configurations similar to the above embodiment will be given the same reference numerals as above and description thereof will be omitted.

Figure 7:
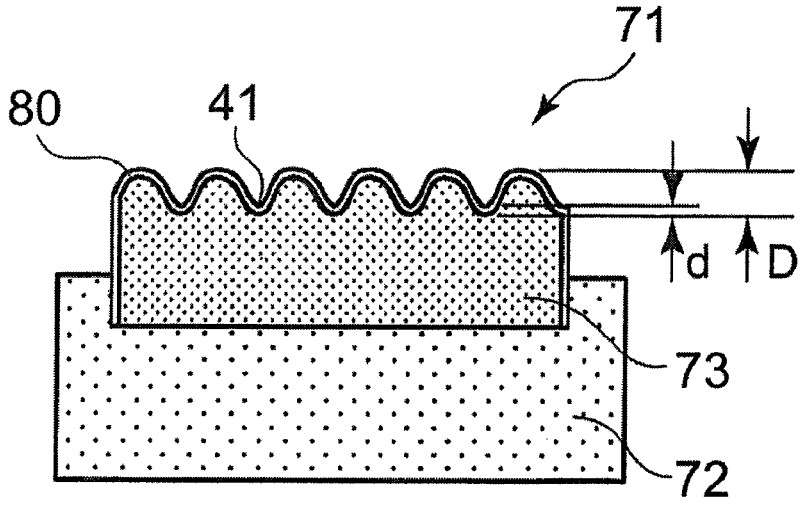
FIG. 7 is a schematic diagram illustrating a pressurizing pad according to a second embodiment of the present invention.

Referring to FIG. 7, a description is given of the pressurizing pad 71 according to the second embodiment. As similar to the pressurizing pad 3 of the first embodiment, the pressurizing pad 71 of the second embodiment includes a pressurizing pad support member 72 supporting an elastic member 73, serving as a pressing portion, made of silicone rubber. The elastic member 73 has a coating layer 80, serving as a surface layer, on a surface thereof to obtain slidability with an inner circumferential surface of a fixing belt 2. The coating layer 80 is formed by adding graphite serving as a solid lubricating agent on the surface of the elastic member 73. The coating layer 80 is provided on the surface of the elastic member 73 of the pressurizing pad 71, and the pressurizing pad 71 is pressed by a compression coil spring 19, so that the coating layer 80 directly slides in contact with the fixing belt 2. Moreover, the solid lubricating agent forming the coating layer 80 includes silicone beads 18 provided thereinside beforehand to set a surface roughness of the pressurizing pad 71. The mixture of the silicone beads 18 and the solid lubricating agent allows the surface roughness Rz of the coating layer 80 to be set between 5 μm and 40 μm. That is, an outside diameter of each of the silicone beads 18 can be selected, so that the surface roughness can be optionally set.

According to the second embodiment, the pressurizing pad 71 includes the elastic member 73 having a plurality of fine grooves on an upper surface thereof in a longitudinal direction, that is, in a direction perpendicular to a rotation direction of the fixing belt 2, and an undulated portion 41 is formed. The upper surface of the elastic member 73 of the pressurizing pad 71 serves as a surface sliding in contact with the fixing belt 2. Accordingly, the upper surface of the elastic member 73 can obtain a certain roughness. A method for molding the undulated portion 41 on the upper surface of the elastic member 73 is described as follows.

Figure 8:
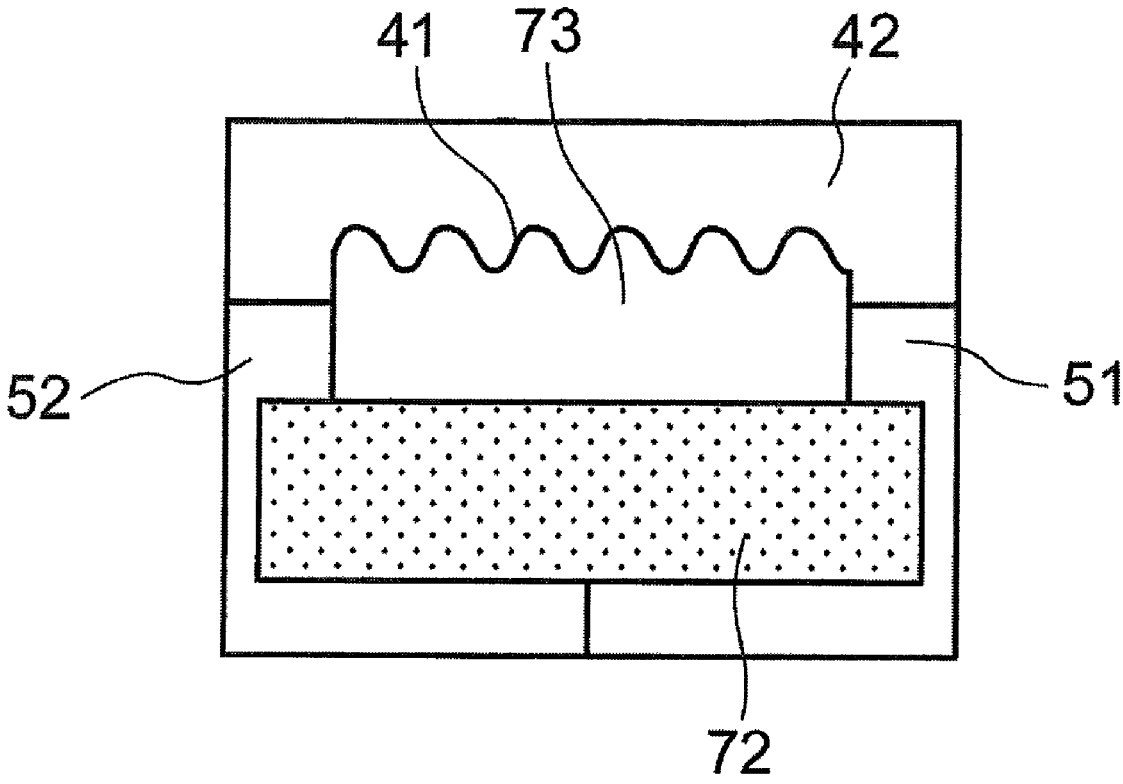
FIG. 8 is a schematic diagram illustrating a method for molding an elastic member of the pressurizing pad.

Referring to FIG. 8, a description is given of the molding method of the elastic member 73 of the pressurizing pad 71. There are two types of molds, an upper mold 42 and lower molds 51 and 52, to be used to mold the elastic member 73 into the pressurizing pad support member 72. Each of the lower molds 51 and 52 is used to mainly support the elastic member 73 of the pressurizing pad 71. The pressurizing pad support member 72 is set in the lower molds 51 and 52. The silicone rubber member of the elastic member 73 is loaded on the pressurizing pad support member 72, and then the upper mold 42 is loaded. After the upper mold 42 is loaded, the pressure and heat is applied to the elastic member 73 on the pressurizing pad support member 72, thereby molding the elastic member 73 on the pressurizing pad support member 72 (primary vulcanization). The pressurizing pad 71 including the elastic member 73 molded therein is heated again (secondary vulcanization) after completion of the primary vulcanization. Subsequently the coating layer 80 added with the graphite as the solid lubricating gent is provided on the surface of the pressurizing pad 71.

The upper mold 42 includes the fine uniform grooves in a longitudinal direction, so that the undulated portion 41 is formed on the surface of the elastic member 73 in the course of molding the elastic member 73. Subsequently, the coating layer 80 is formed on the surface of the elastic member 73 including the undulated portion 41 formed thereon. The undulated portion 41 and the coating layer 80 have a relationship as follows.

$$D>d$$

Where "D" represents a depth of the undulated surface 41 of the elastic member 73, and "d" represents a thickness of the coating layer 80. Accordingly, even in a case where the coating layer 80 is formed on the surface of the elastic member 73, the elastic member 73 has a certain roughness on the surface thereof as illustrate in FIG. 8.

According to the second embodiment, therefore, the undulated portion 41 is formed on the surface of the elastic member 73 of the pressurizing pad 71 in the course of molding the elastic member 73, and a height (i.e., the depth "D") of the undulated portion 41 is arranged to be greater than the thickness "d" of the coating layer 80 to be formed, so that the surface of the pressurizing pad 71 can maintain a proper roughness. Such an undulated portion 41 can be produced without an additional production process. Therefore, the undulated portion 41 can be stably produced by an existing production process. Moreover, in a case where the surface roughness of the coating layer 80 is lowered over time, the pressurizing pad 71 can maintain the surface roughness thereof at least a certain level, thereby reducing the drive torque of the fixing device 10.

According to each of the first and second embodiments of the present invention, the printer 100 serving as the image forming apparatus has been described as an example. However, the embodiments can be applied to, for example, a facsimile machine, a multi-functional peripheral (MFP), and a photocopier. According to each of the first and second embodiments of the present invention, the pressurizing pad is disposed on the inner side of the fixing belt 2. However, the embodiments are not limited thereto. For example, each of the first and second embodiments can be applied to a fixing device having a pressurizing roller (not shown) capable of rotating in synchronization with the fixing belt 2.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A belt device comprising:

a belt member which rotates with rotation of a rotation member; and a pressurizing member including a pressing portion which presses an inner circumferential surface of the belt member, wherein the pressing portion is provided with a coating layer formed of a solid lubricating agent intermixed with fine particles.

2. The belt device according claim 1, wherein the solid lubricating agent includes any of graphite, molybdenum disulfide, fluorine resin, and boron nitride.

3. The belt device according claim 1, wherein the fine particles are made of any of silicone, polymer, heat-resistance resin, and metal.

4. The belt device according claim 1, wherein each of the fine particles has an outside diameter of 5 μm to 40 μm.

5. The belt device according claim 1, wherein the pressing portion has a surface roughness Rz of 5 μm to 40 μm.

6. The belt device according claim 1, wherein the pressing portion includes undulation formed on a surface thereof.

7. The belt device according to claim 1, wherein the pressing portion includes the surface layer formed thereon and is in a shape having undulation on a surface thereof, and wherein the undulation and the surface layer has a relationship of D>d, where "D" represents a depth of the undulation, and "d" represents a thickness of the coating layer.

8. The belt device according to claim 1, wherein the pressurizing member includes a support member and the pressure portion supported by the support member.

9. The belt device according to claim 1, wherein the pressing portion includes an elastic member and the coating layer formed on a surface of the elastic member.

10. The belt device according to claim 1, wherein the pressurizing member allows the inner circumferential surface of the belt member to be pressed using an urging member.

11. The belt device according to claim 1, wherein the rotation member is a fixing member contacting an outer circumferential surface of the belt member.

12. The belt device according to claim 11, wherein the fixing member includes a surface heated by a heating member.

13. The belt device according to claim 11, wherein the pressurizing member presses the belt member towards the fixing member.

14. The belt device according to claim 1, wherein the fine particles are always present both within and on an exterior surface of the coating layer, such that a surface roughness of the pressing portion is maintained.

15. An image forming apparatus comprising:

a medium tray;

a medium conveyance mechanism;

an image forming unit; and a belt device including:

a belt member which rotates with rotation of a rotation member; and a pressurizing member including a pressing portion which presses an inner circumferential surface of the belt member, wherein the pressing portion is provided with a coating layer formed of a solid lubricating agent intermixed with fine particles.

* * * * *